US010400634B2

(12) United States Patent
Öström et al.

(10) Patent No.: US 10,400,634 B2
(45) Date of Patent: Sep. 3, 2019

(54) HEAT RECOVERY SYSTEM AND A METHOD USING A HEAT RECOVERY SYSTEM TO CONVERT HEAT INTO ELECTRICAL ENERGY

(71) Applicant: CLIMEON AB, Kista (SE)

(72) Inventors: Thomas Öström, Stockholm (SE); Per Askebjer, Åkersberga (SE); Joachim Karthäuser, Sollentuna (SE)

(73) Assignee: CLIMEON AB, Kista (SE)

( * ) Notice: Subject to any disclaimer, the term of this patent is extended or adjusted under 35 U.S.C. 154(b) by 0 days.

(21) Appl. No.: 16/067,112

(22) PCT Filed: Jan. 18, 2017

(86) PCT No.: PCT/SE2017/050043
§ 371 (c)(1),
(2) Date: Jun. 28, 2018

(87) PCT Pub. No.: WO2017/127010
PCT Pub. Date: Jul. 27, 2017

(65) Prior Publication Data

US 2019/0120088 A1 Apr. 25, 2019

(30) Foreign Application Priority Data

Jan. 20, 2016 (SE) ..... 1600014

(51) Int. Cl.
*F01K 23/04* (2006.01)
*F01K 23/08* (2006.01)
*F02G 5/02* (2006.01)

(52) U.S. Cl.
CPC ..... *F01K 23/04* (2013.01); *F01K 23/08* (2013.01); *F02G 5/02* (2013.01)

(58) Field of Classification Search
CPC ..... F01K 23/04; F01K 23/08; F02G 5/02
(Continued)

(56) References Cited

U.S. PATENT DOCUMENTS 3,303,646 A * 2/1967 Southam ..... F01K 3/00 60/643
5,724,814 A * 3/1998 Ven ..... F01B 17/00 60/618

(Continued)

FOREIGN PATENT DOCUMENTS

CH 554999 A 10/1974
CN 203626906 U 6/2014

(Continued)

OTHER PUBLICATIONS

CN 201780007039.8—Office Action dated Feb. 20, 2019, 12 pages.

(Continued)

*Primary Examiner* — Hoang M Nguyen
(74) *Attorney, Agent, or Firm* — Haynes Beffel & Wolfeld LLP; Ernest J. Beffel, Jr.; Andrew L. Dunlap

(57) ABSTRACT

A heat recovery system arranged to be used together with a first closed loop system (S1) configured as a first closed-loop thermodynamic Rankine cycle system, to convert heat from a heat generating unit (1) into electrical energy (E). Said heat recovery system comprising a second closed loop system (S2) comprising a second system working medium (W2) configured as a second closed-loop thermodynamic Rankine cycle system arranged to convert the heat in at least one heat stream (HS1) generated by the heat generating unit (1) into a first batch (E1) of electrical energy (E) and a third closed loop system (S3) comprising a circulating third system working medium (W3). In the second closed-loop thermodynamic Rankine cycle system the condensation heat enthalpy of a vaporised second working medium (W2) is transferred to said third system working medium (W3) and the heat from the third system working medium (W3) is used as an initial thermal input to the second closed loop system (S2), thus converting heat from the third system working medium (W3) into a second batch (E2) of electrical energy (Continued)

(E). The invention also relates to a method to use a heat recovery system together with a first closed loop system configured as a first closed-loop thermodynamic Rankine cycle system, to convert heat from a heat generating unit into electrical energy.

12 Claims, 5 Drawing Sheets

(58) Field of Classification Search
USPC ..... 60/655
See application file for complete search history.

(56) References Cited

U.S. PATENT DOCUMENTS 8,650,879 B2 * 2/2014 Freund ..... F01K 23/065 60/604
8,904,791 B2 * 12/2014 Lehar ..... F01K 23/02 60/655
9,038,390 B1 * 5/2015 Kreuger ..... F01K 23/02 60/655
2010/0319346 A1 12/2010 Ast et al.
2013/0168972 A1 7/2013 Ku et al.

FOREIGN PATENT DOCUMENTS

DE 102008005040 A1 7/2009
GB 2038951 A 7/1980
JP 2009191624 A 8/2009
RU 2562745 C1 9/2015

OTHER PUBLICATIONS

Marrero et al, Second law analysis and optimization of a combined triple power cycle, Energy Conversion and Management, vol. 43, No. 4, 557-573, 2002, pp. 557-673.
International Search Report and Written Opinion, PCT Application No. PCT/SE2017/050043, dated Apr. 27, 2017, 11 pages.
International Prelimiinary Report on Patentability (Chapter II), PCT Application No. PCT/SE2017/050043, dated May 15, 2018, 18 pages.

* cited by examiner

HEAT RECOVERY SYSTEM AND A METHOD USING A HEAT RECOVERY SYSTEM TO CONVERT HEAT INTO ELECTRICAL ENERGY

CROSS REFERENCE

This application is the U.S. national stage of PCT Application No. PCT/SE2017/050043, filed Jan. 18, 2017, titled "A HEAT RECOVERY SYSTEM AND A METHOD USING A HEAT RECOVERY SYSTEM TO CONVERT HEAT INTO ELECTRICAL ENERGY" which claims the benefit of and priority to Swedish Patent Application 1600014-3 filed on Jan. 20, 2016.

FIELD OF THE INVENTION

This invention relates to recovery and utilization of waste heat for power generation.

BACKGROUND AND PRIOR ART

This invention addresses the fact that in power generation (power plants, combustion engines, combustion devices, refineries, industry) significant amounts of valuable energy are lost through hot exhaust gases.

A system using a steam turbine to convert the heat in said exhaust gases into useful energy, for example electrical energy, is established and proven technology. A steam turbine could extract thermal energy from exhaust gases independently of any ORC. However, this would require cooling of the steam exiting the steam turbine, and typically requires large and expensive condensation vessels operating under vacuum.

It is also technically feasible to extract more heat from exhaust gases, and to use such heat e.g. at 90° C. in Rankine cycles. However, at low temperatures corrosive substances will condense during heat extraction, possibly leading to severe corrosion problems. Ideally, usage of low temperatures for energy recovery is combined with proper methods for removal of sulfur, nitrogen oxides and other corrosives.

The disclosures and references presented below give a general picture of power plant technology and waste heat recovery systems.

US2013 0341 929A1 by Ralph Greif (University of California) et al describes a variation of the ORC cycle, referred to as Organic Flash Cycle. The authors describe general problems associated with power generation from saturated vapours, see section [0045].

U.S. Pat. No. 8,889,747 by Kevin DiGenova et al (BP, 2011) describes the use of ORC systems in combination with Fischer-Tropsch reactors. U.S. Pat. No. 4,589,258 (Brown Boveri, 1986) discloses general wet steam turbine technology.

U.S. Pat. No. 7,900,431 by George Atkinson et al (Parsons Brinckerhoff, 2006) and U.S. Pat. No. 4,831,817 by Hans Linhardt, 1987, also give interesting general background to wet steam turbine applications.

U.S. Pat. No. 4,455,614 (Westinghouse, 1973) discloses a power plant scheme including a combination of steam turbines and waste heat recovery by employing steam generators.

Various types of steam turbines are available, such as condensing, non-condensing, reheat, extraction and induction types, and the reader is referred to A. Stodola, "Steam and gas turbines", McGraw Hill, and similar text books.

US20140069098A1 (Mitsubishi, 2012) discloses a power-generating device using an ORC which uses heat recovered from an exhaust gas treated in an exhaust gas treatment device, the power-generating device including a heat exchanger, an evaporator, a steam turbine, a power generator, a condenser, and a medium pump.

US20140352301A1 by Torsten Mueller (GM, 2013) discloses a waste heat recovery system for a motor vehicle.

U.S. Pat. No. 8,850,814 by Uri Kaplan (Ormat, 2009) discloses a waste heat recovery system using jacket cooling heat and exhaust gas heat. Here, jacket cooling heat is used to pre-heat a liquid organic working fluid which later is evaporated using heat from exhaust gases. Said heat is delivered in the form of expanded steam which has passed a steam turbine.

SUMMARY OF INVENTION

Despite the known solutions, there is still a need to provide an improved method and a simplified system for recovery and utilization of waste heat for power generation enabling use of low-cost equipment and where maximum use of exergy and easy control is provided.

An object of the invention is to provide such a system and method.

It is feasible and part of the invention to also employ an organic solvent instead of water, as used in the steam turbines, for energy recovery from the exhaust gases. The invention is arranged to recuperate heat from exhaust gases using heat exchangers, a steam turbine and an additional thermodynamic Rankine cycle, preferably an ORC (Organic Rankine Cycle) for recovery of heat at about 70-120° C.

It is also beneficial that the two heat sources, i.e. jacket cooling and exhaust gas, are supplying thermal input to separate systems and can produce energy independent of each other.

An object of the present invention is thus to provide a method and a system using where the different thermodynamic cycles included in the system can be used independent of the other to produce electrical energy. Thus, if one closed-loop thermodynamic system fails, the other still is operative.

A further benefit of the invention is also that the steam turbine utilising a second high temperature thermodynamic cycle is "cooled" using the second stream which is input to the first low temperature thermodynamic cycle.

Another object is to extract all energy generated by a heat generation unit, for example waste heat such as from exhaust gases, and convert it to electricity to the maximum extent possible, thus using maximum thermal input from all available heat streams.

The herein mentioned objects are achieved by a heat recovery system and a method performed by a such a heat recovery system for converting heat from a heat generating unit into electrical energy according to the appended claims.

Hence one aspect of the invention is a heat recovery system arranged to be used together with a first closed loop system configured as a first closed-loop thermodynamic Rankine cycle system, to convert heat from a heat generating unit into electrical energy, wherein said heat generating unit is arranged to generate at least one heat stream. Said heat recovery system comprises a second closed loop system configured as a closed-loop thermodynamic Rankine cycle system arranged to convert the heat in the at least one heat stream into a first batch of said electrical energy. The second closed-loop system comprises a circulating second system working medium, a first heat exchanger arranged to vaporize said second system working medium to become a vapour by transferring heat from said at least one waste heat stream to the first working medium, a turbine arranged to expand said second system working medium and produce energy to be extracted as the first batch of electrical energy and a second heat exchanger arranged to condensate said second system working medium to become a liquid. Said heat recovery system further comprises a third closed loop system comprising a circulating third system working medium. The third system working medium is arranged to be circulated through said second heat exchanger and acts as a condensation medium of said first working medium. Said second heat exchanger is arranged to transfer the condensation enthalpy of the vaporised second system working medium to said third system working medium and increasing its temperature. The heat from the third system working medium is arranged to be used as an initial thermal input to the first closed loop system configured as a closed-loop thermodynamic Rankine cycle system. Said first closed loop system is hereby arranged to convert heat from the third system working medium into a second batch of said electrical energy.

Said heat generating unit may be a power plant of any type, a combustion device, an engine, an incineration plant or the like. The said at least one heat stream may be exhaust heat generated by an exhaust gas system of the heat generating unit. The second closed-loop thermodynamic Rankine cycle system may use a high temperature thermodynamic cycle and the first closed-loop thermodynamic Rankine cycle system may use a low temperature thermodynamic cycle. The low temperature thermodynamic cycle may be an organic Rankine system.

In a heat recovery system according to the above, each closed-loop thermodynamic system can be used independent of the other to produce electrical energy. Thus, if one closed-loop thermodynamic system fails, the other still is operative. Further, here the second thermodynamic closed-loop system is used to boost the thermodynamic input to the first thermodynamic closed-loop system, hereby increasing the efficiency of the first thermodynamic cycle.

In one embodiment, the second closed-loop system of the heat recovery system further comprises a first control arrangement for controlling the circulation and/or pressurization of said second system working medium. In one embodiment, the pressure of said second system working medium directly after said turbine is controlled to be a pressure corresponding to the condensation temperature of said second system working medium. In one embodiment, wherein said second working medium is water, said pressure is controlled to be above atmospheric pressure, i.e. approximately around or above 1 bar. In one embodiment, said first arrangement for controlling the circulation and/or pressurization comprises at least one of a valve and a pump. It is of course possible to use more than one valve and/or pump to control the circulation and/or pressurization.

When the pressure of said second system working medium after the turbine is a pressure corresponding to the condensation temperature of said second system working medium, preferably near or above atmospheric pressure, less condensation occurs in the turbine and more in the second heat exchanger. At a pressure near or above atmospheric pressure at maximum 15% by weight of said second system working medium is condensed during said expansion step. More preferably a maximum 8% by weight is condensed, most preferably a maximum 3% by weight is condensed during said expansion step.

When the pressure of said second system working medium after the expansion is below atmospheric pressure, more condensation occurs in the turbine. Droplets of water in the turbine increase wear. Further, the efficiency of the heat recovery system decreases since less condensation enthalpy will be available in the second heat exchanger. With less available condensation enthalpy, the temperature increase of the third system working medium, acting as thermal input to the first closed-loop system, is lower. A lower thermal input to the first closed-loop system generates less energy.

In one embodiment, said heat generating unit is arranged to generate at least a first waste heat stream and a second waste heat stream, wherein the temperature of said first waste heat stream is higher than the temperature of said second waste heat stream, and wherein the waste heat recovery system is arranged to use the heat from the second heat stream as an initial thermal input to the third closed loop system.

This system utilises the heat from more than one heat source generated by the heat generating unit. Here, the third system working medium receives a stream of an initial temperature generated by the second heat source. The said initial temperature is increased by adding condensation enthalpy from the first closed-loop system.

In one embodiment, the second closed-loop system comprises at least two parallel turbines arranged to expand said second system working medium and to produce energy to be extracted as at least a part of said first batch of electrical energy.

When more than one turbine is used, it is possible to control the system to produce maximum power output even when the heat generating unit is generating a heat stream with a lower temperature than T1, e.g. if the heat generating unit is an engine working on part load.

In one embodiment, the third closed loop system comprises a pump arranged to create a controllable circulation and/or pressurization of said third system working medium in the third closed loop system.

Hereby, the heat transfer between the second system working medium and third system working medium is controlled so that essentially all vaporised second system working medium is condensed during the heat exchange and that the condensation enthalpy of the vaporised second system working medium is transferred to the third system working medium.

In one embodiment, the pump is arranged to pressurize the third closed loop system to a pressure above the pressure of the second system working medium before entering the second heat exchanger.

Hereby, internal boiling is prevented, particularly during shut down procedure.

In one embodiment, the circulation of the third system working medium through the second heat exchanger is arranged to be controlled in order maintain a predefined temperature difference between the temperature of the second system working medium entering the second heat exchanger and the temperature of the second system working medium exiting the second heat exchanger.

When a predefined temperature difference is maintained, it can be determined that essentially all vaporised second system working medium is condensed during the heat transfer and that the condensation enthalpy of the second system working medium is transferred to the third system working medium.

Another aspect of the invention relates to a method to use a heat recovery system together with a first closed loop system configured as a first closed-loop thermodynamic Rankine cycle system, to convert heat from a heat generating unit into electrical energy. Said heat generating unit is arranged to generate at least one heat stream. The heat recovery system comprises a second closed loop system comprising a second system working medium, wherein the second closed loop system is configured as a second closed-loop thermodynamic Rankine cycle system arranged to convert the heat in the at least one heat stream into a first batch of said electrical energy and a third closed loop system comprising a circulating third system working medium. The method comprises the steps: vaporizing said second system working medium to become a vapour by transferring heat from said at least one heat stream to the second system working medium, expanding said second system working medium and extracting a first batch of electrical energy, condensing said second system working medium to become a liquid having a lower heat enthalpy than said vapour. The method further comprises the steps: transferring the condensation heat enthalpy of the vaporised second system working medium to said third system working medium and increasing its temperature, using the heat from the third system working medium as an initial thermal input to the first closed loop system configured as a first closed-loop thermodynamic Rankine cycle system arranged to convert heat from the third system working medium into a second batch of said electrical energy.

In one embodiment, said method comprises the step of: controlling the pressure of said expanded second system working medium to be above atmospheric pressure.

In one embodiment, said method comprises the step of: using the heat from a second heat stream generated by said heat generating unit as an initial thermal input to the third closed loop system.

In one embodiment, said method comprises the step of: controlling the circulation and/or pressurization of said third system working medium. In one embodiment, the circulation of said third system working medium is controlled based on a measured temperature difference between the temperature of said second system working medium of the expanded and condensed second system working medium in order maintain a predefined temperature difference. In another embodiment, the pressurization of said third system working medium is controlled so that the pressure of the third system working medium is above the pressure in the expanded second system working medium.

In one embodiment, said method uses a heat recovery system according to any of embodiments of the first aspect of this invention.

DETAILED DESCRIPTION OF THE FIGURES

In the following descriptions of embodiments are presented. Temperatures given should be interpreted with a margin of at least +/−5° C. Pressures given should be interpreted with a margin of at least +/−10%. The definition "thermodynamic cycle" can be any power generation cycle, including Rankine cycle, Organic Rankine cycle (ORC), and in the context of this text any process converting heat to mechanical energy and ideally to electrical energy.

Figure 1:
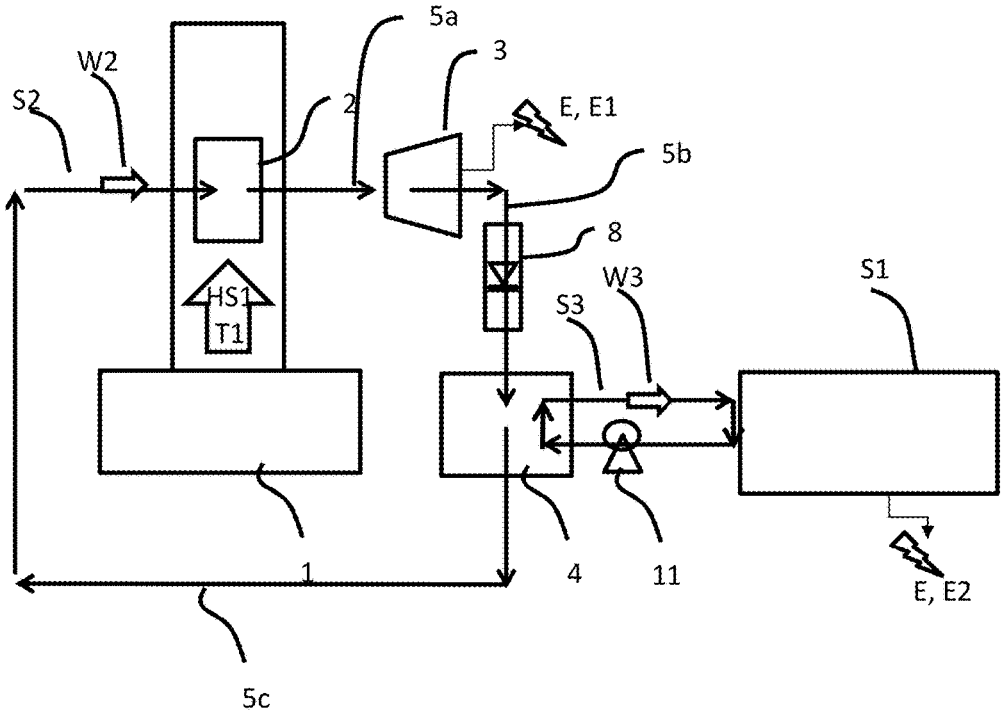
FIG. 1 is a schematic drawing of the heat recovery system according to a first embodiment of the invention.

FIG. 1 is a schematic drawing of the heat recovery system 1, according to the invention, arranged to be used together with a first closed loop system S1 configured as a first closed-loop thermodynamic Rankine cycle system, to convert heat from a heat generating unit 1 into electrical energy E. The heat generating unit 1 is arranged to generate at least one heat stream HS1 with a first high temperature range T1. The heat generating unit may be a power plant of any type, a combustion device, an engine, an incineration plant or the like. The first heat stream HS1 is in one embodiment the exhaust gases produced in the unit's exhaust gas system. The first heat stream HS1 may be a flow of hot first heat source medium in gaseous form, for example through a chimney. The temperature T1 of the first heat stream HS1 is preferably above 200° C.

The heat recovery system comprises a second closed-loop system S2 and a third closed loop system S3.

The second closed-loop system S2 is configured as a second closed-loop thermodynamic Rankine cycle system arranged to convert the heat in the at least one heat stream HS1 into a first batch E1 of said electrical energy E. The second closed-loop system S2 may be a high temperature thermodynamic cycle. The second closed-loop system S2 comprises a circulating second system working medium W2. Said second system working medium W2 is chosen as a medium changing phase between liquid and vapour at a certain vaporization temperature and to change phase between vapour and liquid at a certain condensation temperature. In one embodiment, the second system working medium W2 of the second closed-loop system S2 may comprise water or a solvent such as methanol, ethanol, acetone, isopropanol or butanol, or ketones or high-temperature stable silicone derivatives or freons/refrigerants. When the second system working medium W2 is water said condensation temperature is 100° C. corresponding to pressure near or above atmospheric pressure, i.e. 1 bar.

The second closed-loop system S2 comprises a first heat exchanger 2 arranged to vaporize said second system working medium W2 by transferring heat from said at least one waste heat stream HS1 to the second system working medium W2. The second system working medium W2 is preferably heated by the first heat stream HS1 at a nearly constant pressure in the first heat exchanger 3 to become a dry saturated vapour or steam. In one embodiment, when said first medium is water, said evaporation step will be resulting in steam at 170° C. and 6 bar. This vapour/steam is led through a pipe 5*a* to a turbine 3. The turbine 3 is arranged to expand said second system working medium W2 and produce energy to be extracted as the first batch of electrical energy E1. Said turbine 3 may be a steam turbine. This expansion step decreases the temperature and pressure of the vapour resulting in an expanded second system working medium having a specific temperature and pressure. A valve 10 can be used to create a pressure drop before the turbine 3. A controlled pressure drop before the turbine can ensure that the steam entering the turbine is superheated. The expanded vapour exiting said first turbine is lead through pipe 5*b* to a second heat exchanger 4. The second heat exchanger 4 is arranged to condensate said second system working medium W2 to become a liquid resulting in a condensed second system working medium having a specific temperature and pressure. Said second system working medium W2 is condensed at a nearly constant temperature. In one embodiment the temperature change is within the range 1-5° C. maximum. The second heat exchanger 4 thus acts as a condenser as well as a heat exchanger. Condensed steam is led through pipe 5*c* back to the first heat exchanger 2.

The second closed-loop system S2 also comprises a first control arrangement 8, 12 for controlling the circulation and/or pressurization of said second system working medium W2. Especially this control arrangement is used to control the pressure on the low pressure side of the turbine 3. Said first control arrangement may comprise a valve 8, or an adjustable restriction of any kind. The first control arrangement may also comprise a pump 12, see FIG. 2. The pressure on the low pressure side of the turbine 3, i.e. after the expansion step, is measured by sensors and controlled to be a pressure corresponding to the condensation temperature of said second system working medium, preferably near or above atmospheric pressure, i.e. 1 bar. When the pressure is above atmospheric pressure, at maximum 15% by weight of said second system working medium W2 is condensed during said expansion step, thus in the turbine. In other embodiments 3, 4, 5, 8, 10 or 12% by weight condensation of steam inside the turbine is acceptable.

The third closed loop system S3 comprising a circulating third system working medium W3. The third system working medium W3 is preferably mainly water, possibly with additives e.g. for anti-corrosion effect. The third system working medium W3 is not arranged to change phase during the circulation in the third closed loop system. The third system working medium W3 is circulated through the second heat exchanger 4. When the both the second system working medium W2 and the third system working medium W3 are passing through the second heat exchanger 4, the condensation enthalpy of the vaporised second system working medium W2 is transferred to the third system working medium W3. The third closed loop system S3 further comprises a second control arrangement 11, 14 for controlling the circulation and/or pressurization of said third system working medium W3 through thirds closed loop system S3 and the second heat exchanger 4. The second control arrangement 11, 14 comprises a pump 11 arranged to control the circulation of said third system working medium W3. The second control arrangement may also comprise a valve 14, see FIG. 2. This valve 14 is preferably arranged in the second closed-loop system S2, before the second heat exchanger 4. The flow of said third system working medium W3 through the second heat exchanger 4 may be arranged to be controlled in order maintain a predefined temperature difference between the temperature of the second system working medium W2 entering the second heat exchanger 4 and the temperature of the second system working medium W2 exiting the second heat exchanger 4. The temperature difference of the second system working medium over the second heat exchanger is controlled by the first control arrangement 8, 12 for controlling the circulation and/or pressurization of said second system working medium W2 through the second heat exchanger 4. The pump 11 arranged to control this circulation of said third system working medium W3 can thus also be used to control the heat transfer between the second system working medium W2 and third system working medium W3 so that essentially all vaporised second system working medium W2 is condensed during the heat exchange. The pump 11 may also be arranged to pressurize the third closed loop system S3 to a pressure above the pressure of the second system working medium W2 in the first closed-loop system before entering the second heat exchanger 4. In order to be able to control the pressure and temperatures, sensors are arranged to measure these parameters on required locations in each closed loop system.

The heat from the third system working medium W3 is used as an initial thermal input to a first closed loop system S1. The first closed loop system S1 is configured as a first closed-loop thermodynamic Rankine cycle system. The first closed loop system S1 is arranged to convert heat from the third system working medium W3 into a second batch E2 of said electrical energy E. The first closed-loop system S1 may be a low temperature organic Rankine thermodynamic cycle and is further described in FIG. 4.

The third system working medium W3 is arranged to be circulated thorough said second heat exchanger 4 and act as a condensation medium of said second system working medium W2. In the second heat exchanger 4, preferably all or most of the condensation enthalpy from condensation of said second system working medium W2 is transferred to the third system working medium W3 supplying the first low temperature thermodynamic cycle used in the first closed-loop system S1. Said second heat exchanger 4 may be a tube and shell type heat exchanger. The first closed-loop system S1 can operate only using this third system working medium W3 as thermal input.

Figure 2:
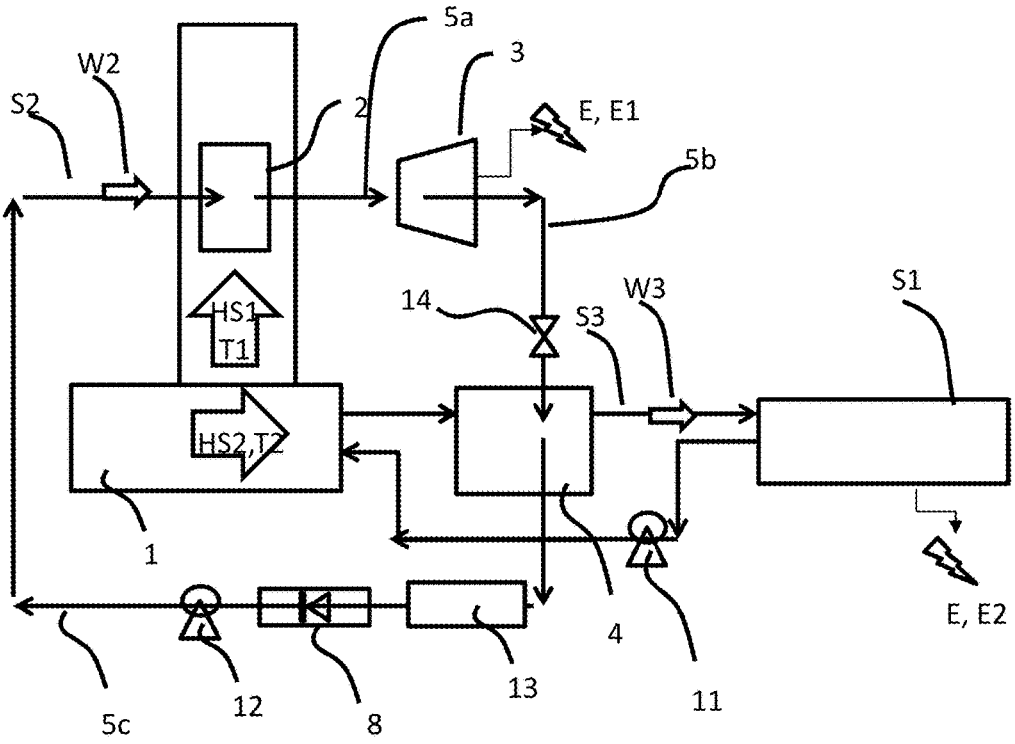
FIG. 2 is a schematic drawing of the heat recovery system according to a second embodiment of the invention.

FIG. 2 is a schematic drawing of the heat recovery system according to a second embodiment of the invention. In this embodiment, the heat generating unit is arranged to generate at least a first heat stream HS1 and a second heat stream HS2 at a temperature T2. The temperature T1 of said first heat stream HS1 is higher than the temperature T2 of said second heat stream HS2. The second temperature T2 is preferably below 120° C., more preferably, below 100° C. and most preferably within an interval 60-99° C., preferably 80° C. Heat from the second heat stream HS2 is used as an initial thermal input for the third closed loop system S3. In one embodiment, the second heat stream HS2 can be said to be the stream of third system working medium W3. In one embodiment, the second heat stream HS2 is originating from cooling of the heat generating unit 1, for example by a cooling medium circulated through or over the heat generating unit. In one embodiment, the cooling medium is the jacket cooling water. In one embodiment, the cooling medium is the third working fluid W3.

An arrangement for controlling the pressure comprising a valve 8 and/or a pump 12, may be placed before or after the second heat exchanger 4, to ensure flow of liquid second system medium W2 in the second closed-loop system S2 of this embodiment. A pump 12 may also be used in the first embodiment, show in FIG. 1. This pump 12 and valve 8 regulate the flow of liquid medium such that steam condensation enthalpy is transferred to the third system working medium W3, the thermal input of the first closed-loop thermodynamic system S1, to the maximum extent possible. The controlling the pressure of said second system working medium (W2) directly after said turbine (3) to a pressure corresponding to the condensation temperature of said second system working medium (W2). In the embodiment where the third system working medium W3 is jacket water, it is preferred that jacket cooling water is heated from 85° C. to e.g. 95° C. in the second heat exchanger 4. It is also preferred that the steam pressure in pipes 5*b* and 5*c* are above atmospheric pressure, thus in the order of 1 bar or above.

Heat supply to the first closed-loop thermodynamic system S1 by the first heat source HS1 and the optional second heat source, i.e. for example a) exhaust gas system and b) jacket cooling, are controlled by software and hardware controls (valves etc) for optimized heat utilization.

In one embodiment, also shown in FIG. 2, a second condenser 13 is arranged downstream said second heat exchanger 4. This, condenser can be used if the amount of heat generated by the heat generating unit exceed the amount of energy possible to convert into electrical energy by said first closed-loop system S1. Thus, it can be used when not all second system working medium W2 is possible to condense in the second heat exchanger 4.

Figure 4:
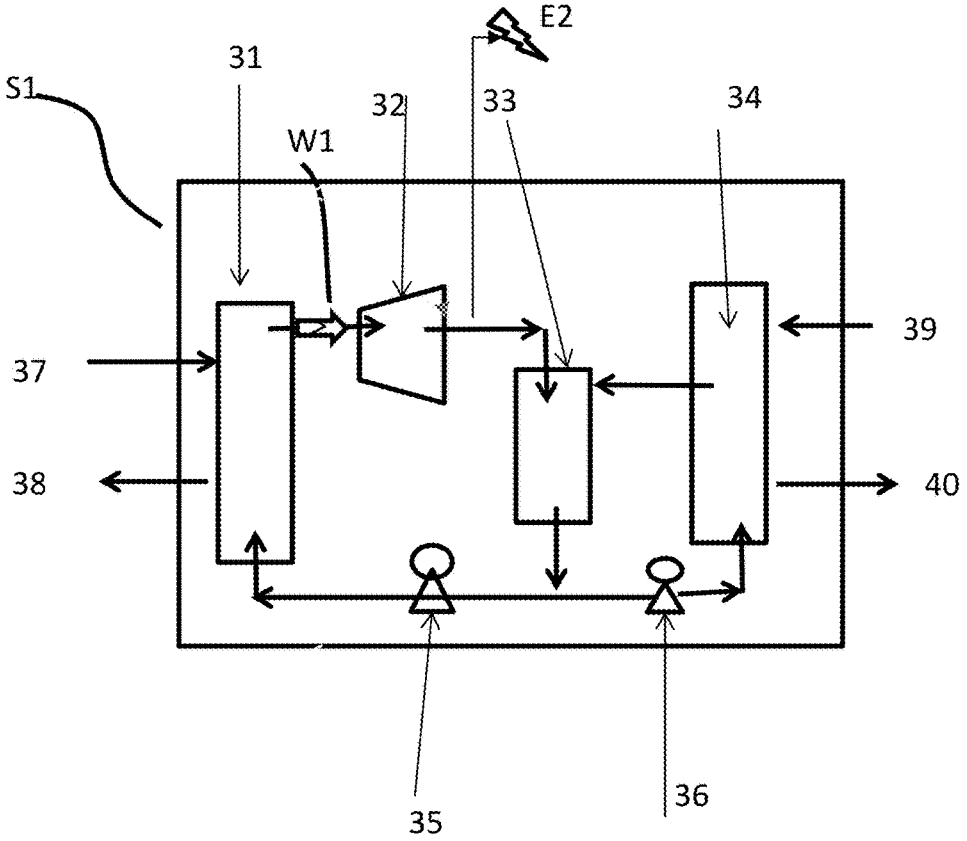
FIG. 4 shows the first closed-loop system S1 in detail.

The first thermodynamic cycle system S1 requires cooling, these heat flows are not shown in FIG. 1 but are further described in FIG. 4. Also, sensors are employed in all three closed-loop systems, e.g. to monitor pressure, temperature, air content of heat carriers etc. in order to ensure controlled operation of the systems. These are not shown in FIGS. 1 and 2 for the sake of simplicity. A deaeration device or device for removal of non-condensable gases may be used in the first and/or second closed-loop system, e.g. placed before pump 12.

In FIG. 2, the third system working medium W3, e.g. jacket cooling water, passes through the second heat exchanger 4 into the first closed-loop thermodynamic system S1, using at least one of a Rankine cycle (RC) or Organic Rankine Cycle (ORC) to produce power. Said first closed-loop thermodynamic system S1 operating between 70-120° C. on the hot side and 0-35° C. on the cold side. See FIG. 4 for more details. The return flow of the jacket cooling medium is guided through a pipe-back into the heat generating unit 2, for example an engine.

Figure 3:
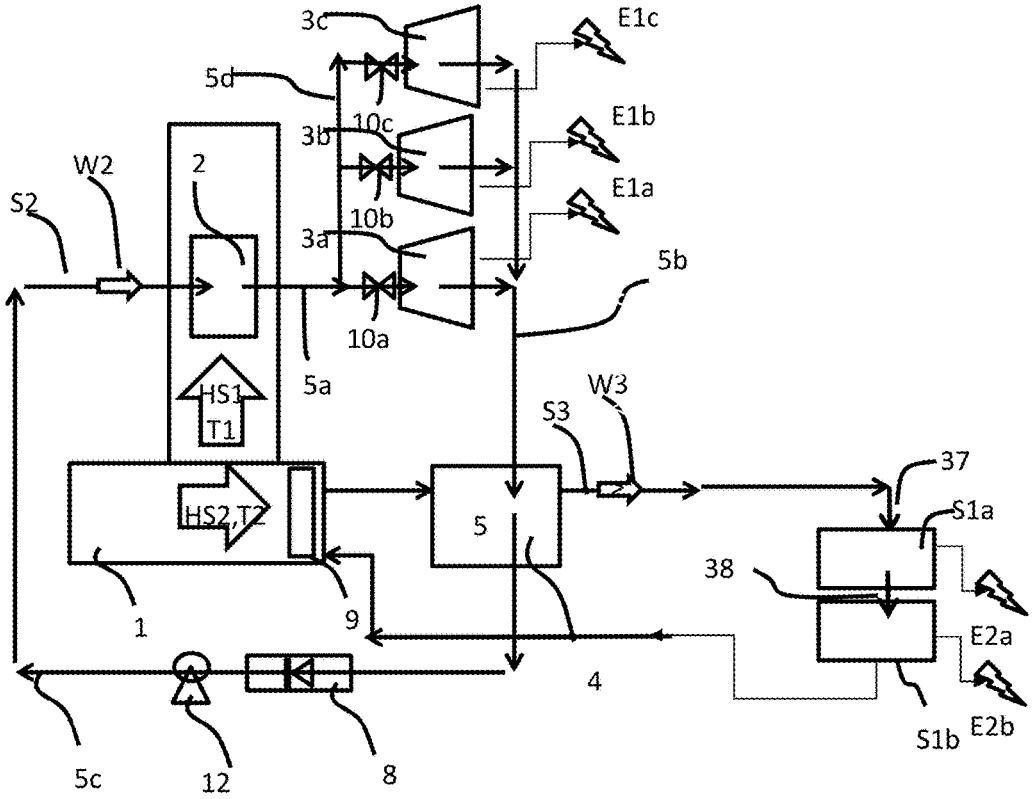
FIG. 3 shows an embodiment of FIG. 2 where a plurality of turbines is employed for extracting electrical energy from the exhaust gases.

FIG. 3 shows an embodiment of FIG. 1 where a plurality of turbines 3*a*, 3*b*, 3*c* is employed for extracting electrical energy from the first heat source HS1. At least two parallel turbines can be used, but here three turbines are disclosed. A first piping part 5*a*, arranged after the first heat exchanger 2 comprises a manifold 5*d* arranged to divide the first piping part 5*a* into at least two parallel first piping part branches. Each branch comprises a turbine 3*a*, 3*b*, 3*b* arranged to expand said second system working medium W2 and to produce energy to be extracted as at least a part E1*a*, E1*b*, E1*c* of said first batch of electrical energy E1. A similar manifold is used to combine the exiting steam into pipe 5*b*, leading to the second heat exchanger 4. Valves 10 can be used to create a pressure drop before each turbine. A controlled pressure drop before each turbine can ensure that the steam entering the turbine is superheated. The turbines are preferably dimensioned so that when the heat generating unit is generating maximum amount of heat, for example an engine running on full speed, all turbines are running at their optimum efficiency. When the heat generating unit is generating less heat, i.e. for example an engine running on part load, at least one of said at least two turbines can be shut off.

FIG. 3 also shows an embodiment where at least two first thermodynamic closed-loop systems S1*a*, S1*b* are coupled in a parallel or sequential manner (sequential in this picture). In parallel mode, a manifold is distributing hot water flow (37) into at the least two first thermodynamic closed-loop system S1, and depending on the amount of heat available generated by the first heat source HS1, at least one first thermodynamic closed-loop system S1 may be switched off or switched on. In sequential mode, hot water enters a first thermodynamic closed-loop system S1*a* as flow 37, and the exiting flow 38 may constitute the entering flow 37 for the second first thermodynamic closed-loop system S1*b*. This mode of operation enables a larger temperature reduction of flow 37/38 as would be possible in the parallel operation mode. Cooling can also be parallel or sequential, but is preferably parallel in the case of marine applications.

FIG. 4 shows the first thermodynamic closed-loop system S1 in detail. The first thermodynamic closed-loop system S1 comprises a first system working medium W1. The first thermodynamic closed-loop system S1 may in one embodiment be a low temperature Rankine cycle system, i.e. an organic Rankine cycle system. Said first system working medium W1 is configured to change phase between liquid and vapour at a second phase change temperature which is a lower temperature than the second system working medium W2 phase change temperature. In one embodiment, the first system working medium W1 is a fluid and may comprise a low boiling solvent such as methanol, ethanol, acetone, isopropanol or butanol or methylethylketone or other ketones or refrigerants known in the art. A liquid heat flow 37, i.e. the third system working medium W3, for example jacket cooling water, enters a heat exchanger 31 and exits said heat exchanger as return flow 38, thereby providing heat input to the first system working medium W1 which is evaporated in heat exchanger 31. Evaporated pressurized gas exits heat exchanger 31 and expands in turbine 32 and generates the second batch of electrical energy E2. The turbine 32 is coupled to an electric generator, not shown, generating said electrical energy. The first working medium W1 then enters condensation vessel 33 in which the working medium is liquefied. Liquid working medium W1 leaves vessel 33 near the bottom and is partly pumped through pump 36 into heat exchanger 34 for cooling and re-entering vessel 33, e.g. as spray for efficient condensation. Heat exchanger 34 is cooled by entering cooling flow 39 (cold) and exiting cooling flow 40. Cooling flow may for example be sea water, if a marine engine is the heat generating unit. Liquid from vessel 33 is partly (i.e. total flow from vessel 33 minus flow through pump 36) pumped using pump 35 to heat exchanger 31 for evaporation, closing the cycle. Typical temperatures may be: flow 37: 70-110° C., flow 38: 60-85° C., flow 39: 0-30° C., flow 40: 10-40° C.

Figure 5:
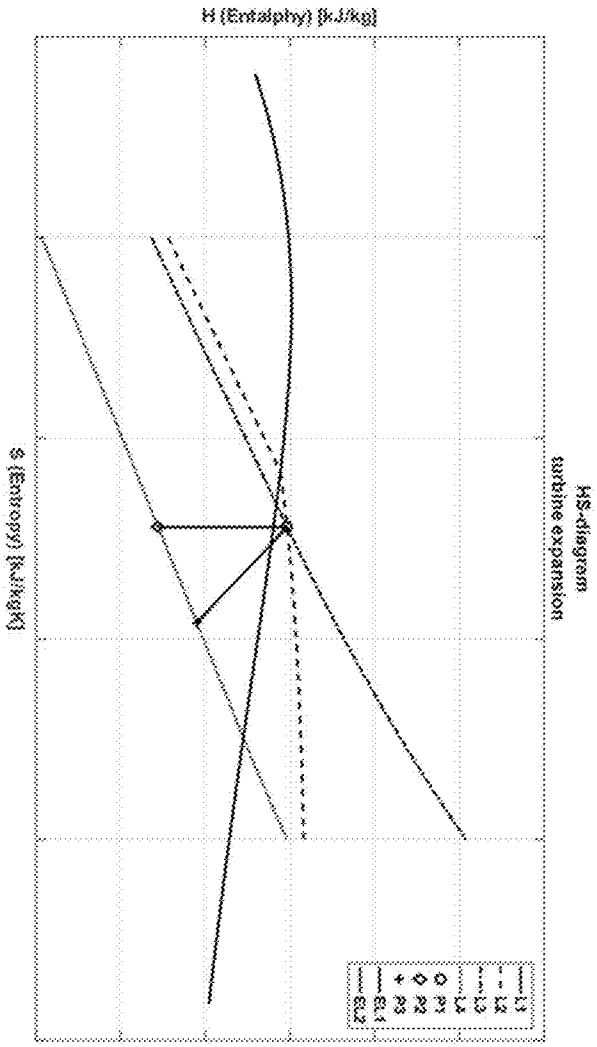
FIG. 5 is a schematic drawing of the enthalpy-/entropy diagram of water (saturation line P1), indicating the preferred working points P2 (=start) and P3 (=end) of a turbine arranged to expand the second system working medium and extracting the first batch of electrical energy.

FIG. 5 is a schematic drawing of the enthalpy-/entropy diagram of the second working medium, preferably water. On the diagram, lines of constant inlet and outlet pressure L3, L4 and constant temperature L2 are plotted, so in a two-phase region A1 below the saturation line L1, the lines of constant pressure and temperature coincide with its saturation line. P1 corresponds to the preferred slightly superheated inlet conditions where the line of constant temperature L2 and the line of constant pressure L3 cross each other. The ideal expansion corresponds to the line EL1 ending in point P2 at the outlet pressure line L4. However, an ideal expansion cycle is impossible. Therefore the actual expansion in the turbine 3 ends in point P3 on the constant pressure line L4 corresponding to a dryness fraction (by mass) of gaseous substance that is at least 0.85 in the wet region. Thus, the expanded steam at the turbine exit comprises less than 5%, or less than 8% or less than 15% of condensed vapour, depending on the turbine type and the conditions. In this case a steam turbine is using water as the second working fluid W2. The expansion of slightly superheated steam from point P1 to point P3 is regulated by the first control arrangement 8, 12 for controlling the circulation and/or pressurization of the second system working medium W2, i.e. by valve 8 or the pump 12, as shown in FIG. 2. Thus, the pressure of the expanded second system working medium W2 directly after said turbine 3 is controlled to be a pressure above the pressure corresponding to the condensation temperature of said second system working medium W2.

Exemplary Embodiments a) Marine Engines

Hot jacket cooling water exits marine engines typically at 85° C., and is fed back into the engine at typically 75° C. Instead of cooling this heat with sea water, the heat is supplied to a thermodynamic cycle such as a Rankine cycle. Exhaust gases from marine engines are sent through a chimney at typically above 200° C. Within the exhaust gas system, heat is extracted such that the second system working medium W2, preferably water, is evaporated by the first heat exchanger 4, preferably providing steam at 170° C. and 6 bar. The first heat exchanger 4 is in this application usually named exhaust gas boiler, EGB. Said steam is used to drive a steam turbine 3 to produce electricity E1. Steam is expanded to and condensed at preferably 98° C. and at least to atmospheric pressure. The condensation heat is, to the maximum extent possible, transferred to the liquid input to the first closed-loop thermodynamic cycle S1. Practically, a second heat exchanger 4 may be employed in which condensate heat from the steam turbine 3 exit is transferred to incoming third system working medium, i.e. hot jacket cooling water, and said third system working medium, i.e. hot jacket cooling water, is raised in temperature from 85° C. to 95° C. This way, the first closed-loop thermodynamic cycle S1 can produce electricity using a temperature difference of (95−75=20° C.) instead of only (85−75=10° C.). The condensate from the steam turbine is pumped back to the exhaust gas system, for the steam turbine cycle to start again. Heat supply to the thermodynamic cycle by a) jacket cooling and b) exhaust gas system are controlled by software and hardware controls (valves etc) for optimized heat utilization.

In a practical embodiment, hot jacket cooling water, i.e. third system working medium W3, provides 50% of the thermal input to the first closed-loop thermodynamic cycle, and heat from the exhaust gas recovery, i.e. second system working medium W2, provides the remaining 50% of the thermal input, as apparent from the temperature data given above. In this arrangement, the first closed-loop thermodynamic cycle S1 produces some 70% of the totally extractable electricity whilst the second closed-loop thermodynamic cycle S2, utilizing the steam turbine, produces the remaining 30%.

In one embodiment, 150 kW are produced by the thermodynamic cycle fed by 82° C. jacket cooling water, lifted to 95° C. by heating with condensate from the steam turbine cycle. Jacket cooling is fed back to the engine at 72° C. 170° C. steam is driving a steam turbine producing an additional 54 kW at a turbine efficiency of 60% (steam quality=0.96, mass flow=0.3 kg/s).

b) Land-based Generator Sets for Electricity Production

Essentially, land based generator sets are almost identical to large ship engines. The methods described under a) can be used with minor modifications.

c) Power Plants and Industrial Waste Heat

The system and method according to the invention can universally be applied where the following is available: an initial second system working medium temperature is at least 40° C. or preferably more than 60° C. higher than the initial third system medium temperature. The initial second system working medium temperature depend on the temperature T1 of the first heat source. In one embodiment of the invention, the initial third system working medium temperature depend on the temperature T2 of the second heat source HS2. In many industries and power plants, e.g. in the steel, aluminium and metal industry, in biomass, waste incineration and other power plants, in the cement, paper, chemical, oil refining and many other industries, the initial temperature of the third system working medium is e.g. 60-100° C. Initial temperature of the second system working medium is in these cases above 140° C.

Applications are also feasible where hot exhaust gases are used as thermal input for power generation by (steam) turbines, and the condensation enthalpy from said steam turbines is used for increasing the temperature of the thermal input of thermodynamic cycles including ORC and specifically including Climeon's C3 thermodynamic cycle. The first thermal input to the thermodynamic cycle may come from a different source.

d) Other Embodiments

In one embodiment, the initial third system working medium temperature is at a temperature of 60, 70, 80, 90, 100, 110 or 120° C. or more. In this case, the first heat stream, typically from exhaust gases, may provide condensation enthalpy from condensing a working medium, typically water. The working points of the steam turbine may be set such that e.g. steam condenses at 110° C. and a pressure of above 1.5 bar.

In one embodiment, a stream of low temperature third working fluid at 55-75° C. used in the first low temperature thermodynamic cycle, such as available in the paper industry, is contacted or heat-exchanged with a second stream of high temperature second system working fluid W2 used in the first high temperature thermodynamic cycle, i.e. condensate downstream of a steam turbine which is powered by exhaust gases, with the purpose to increase the temperature of the heat input to the first low temperature thermodynamic cycle to e.g. 75-95° C. In a sense, the stream of third system working medium W3 serves as highly efficient cooling source for the condensation of steam downstream of the steam turbine.

In one embodiment, steam turbines employed are of axial or radial type. Axial turbines tolerate up to about 13% by weight liquid droplets. For radial turbines, less practical experience is available, but liquid contents up to 10% are considered acceptable.

In one embodiment relevant for the metal industry, waste heat from hot rolling of steel or from hot minerals produced during metal, e.g. iron, production is extracted, representing the first heat source HS1.

It should be understood that above embodiments are merely examples of useful arrangements and temperature/pressure/medium combinations to achieve the objective of the invention, namely to utilize waste heat from various processes including combustion processes efficiently and convert said waste heat to useful energy, preferably electricity.

The foregoing description of the preferred embodiments of the present invention is provided for illustrative and descriptive purposes. It is not intended to be exhaustive or to restrict the invention to the variants described. Many modifications and variations will obviously be apparent to one skilled in the art.

The invention claimed is:

1. A heat recovery system arranged to generate a thermal input to a first closed loop system configured as a first closed loop thermodynamic Rankine cycle system arranged to convert waste heat from a heat generating unit into electrical energy, the heat recovery system comprising:

a second closed loop system configured as a second closed loop thermodynamic Rankine cycle system arranged to convert heat in at least one first heat stream generated by exhaust gases produced in an exhaust gas system of the heat generating unit into a first batch of electrical energy, the second closed loop system comprising:

a circulating second system working medium; and a first heat exchanger in which the second system working medium is arranged to vaporize to become a vapor by a transfer of heat from the at least one first heat stream to the second system working medium;

a turbine arranged to expand the second system working medium and produce energy to be extracted as the first batch of electrical energy;

a second heat exchanger in which the second system working medium is arranged to pass through and to condensate to become a liquid; and a third closed loop system comprising a circulating third system working medium arranged to circulate in the second heat exchanger, wherein the third system working medium is in a liquid phase and is not arranged to change phase during the circulation in the third closed loop system and is arranged to act as a condensation medium of the second system working medium, wherein a condensation enthalpy of the vaporized second system working medium is transferred to the third system working medium to increase a temperature of the third system working medium, wherein the third closed loop system is arranged such that heat from the third system working medium is used as a thermal input to the first closed loop thermodynamic Rankine cycle system, wherein the third closed loop system comprises an arrangement, defined as a second arrangement, for controlling at least one of the circulation and a pressurization of the third system working medium through the second heat exchanger, wherein the second closed loop system further comprises a first control arrangement for controlling at least one of the circulation and a pressurization of the second system working medium, and wherein the first control arrangement is arranged to control the pressure of the second system working medium, directly after the turbine, to be above atmospheric pressure.

2. The heat recovery system according to claim 1, wherein the first control arrangement is arranged to control the pressure of the second system working medium, directly after the turbine, to be a pressure above a pressure corresponding to a condensation temperature of the second system working medium.

3. The heat recovery system according to claim 1, wherein the first control arrangement for controlling the at least one of the circulation and the pressurization comprises at least one of a valve and a pump.

4. The heat recovery system according to claim 1, wherein the third closed loop system is arranged such that heat from a second heat stream generated by the heat generating unit, is arranged to be used as an initial thermal input to the third closed loop system, and wherein a temperature of the at least one first heat stream is higher than a temperature of the second heat stream.

5. The heat recovery system according to claim 1, wherein the second closed loop system comprises at least two parallel turbines arranged to expand the second system working medium and to produce energy to be extracted as at least a part of the first batch of electrical energy.

6. The heat recovery system according to claim 1, wherein the second arrangement for controlling the at least one of the circulation and the pressurization comprises at least one of a valve and a pump.

7. A method of using a heat recovery system arranged to generate a thermal input to a first closed loop system configured as a first closed loop thermodynamic Rankine cycle system arranged to convert heat from a heat generating unit into electrical energy, the heat generating unit being arranged to generate at least one first heat stream, and the heat recovery system comprising:

a second closed loop system comprising a second system working medium, wherein the second closed loop system is configured as a second closed loop thermodynamic Rankine cycle system arranged to convert heat in the at least one first heat stream into a first batch of the electrical energy (E); and a third closed loop system comprising a circulating third system working medium, wherein the method comprises:

vaporizing the second system working medium to become a vapor by transferring heat from the at least one first heat stream to the second system working medium;

expanding the second system working medium and extracting a first batch of electrical energy;

condensing the second system working medium to become a liquid having a lower heat enthalpy than the vapor;

transferring condensation heat enthalpy of the vaporized second system working medium to the third system working medium;

using heat from the third system working medium as a thermal input to the first closed loop system, wherein the first closed loop system converts heat from the third system working medium into a second batch of electrical energy; and controlling at least one of the circulation a pressurization of the third system working medium in the third closed loop system, wherein the circulation of the third system working medium is controlled based on a measured temperature difference between a temperature of the expanded second system working medium and a temperature of the condensed second system working medium in order maintain a predefined temperature difference, and wherein the third system working medium is in a liquid phase and is not arranged to change phase during the circulation in the third closed loop system.

8. The method according to claim 7, wherein further comprising controlling that at least one of the circulation and the pressurization of the second system working medium.

9. The method according to claim 8, wherein the pressure in the second system working medium, when expanded, is controlled to correspond to a condensation temperature of the second system working medium.

10. The method according to claim 8, wherein the pressure of the expanded second system working medium is controlled to be above atmospheric pressure.

11. The method according to claim 7, further comprising:

using heat from a second heat stream generated by the heat generating unit as an initial thermal input to the third closed loop system.

12. The method according to claim 7, wherein the pressurization of the third system working medium is controlled so that the pressure of the third system working medium is above a pressure in the expanded second system working medium.

* * * * *